United States Patent [19]

Potthast et al.

[11] Patent Number: 4,998,939

[45] Date of Patent: Mar. 12, 1991

[54] HOSPITAL BED WITH GUARD RAIL ACTUATED SAFETY APPARATUS

[75] Inventors: James W. Potthast, Chicago; Thomas J. Ring, Harvey, both of Ill.

[73] Assignee: R & P Joint Venture, Chicago, Ill.

[21] Appl. No.: 250,306

[22] Filed: Sep. 28, 1988

[51] Int. Cl.[5] ..... A47C 21/08

[52] U.S. Cl. ..... 5/424; 5/425; 5/428; 5/60

[58] Field of Search ..... 5/60, 86, 424–430; 16/35 R

[56] References Cited

U.S. PATENT DOCUMENTS

| | | | |
|---|---|---|---|
| 2,450,971 | 10/1948 | Letch | 5/86 |
| 2,591,082 | 4/1952 | Lynch . | |
| 2,734,104 | 2/1956 | Gollhofer . | |
| 2,945,242 | 7/1960 | Heiden | 5/86 |
| 3,012,255 | 12/1961 | Diehl . | |
| 3,100,899 | 8/1963 | Wright | 5/430 |
| 3,336,609 | 8/1967 | Taylor . | |
| 3,438,067 | 4/1969 | Saunders | 5/425 X |
| 3,781,843 | 12/1973 | Harrison et al. . | |
| 3,840,917 | 10/1974 | Taylor . | |
| 3,846,854 | 11/1974 | Bryant . | |
| 3,930,273 | 1/1976 | Stern . | |
| 4,067,005 | 1/1978 | Levy et al. . | |
| 4,142,259 | 3/1979 | Moore | 5/428 X |
| 4,403,214 | 9/1983 | Wolar | 5/424 X |
| 4,509,217 | 4/1985 | Therrien . | |
| 4,534,077 | 8/1985 | Martin | 5/424 |
| 4,724,554 | 2/1980 | Kowalski et al. | 5/424 X |

*Primary Examiner*—Michael F. Trettel
*Attorney, Agent, or Firm*—Potthast & Ring

[57] ABSTRACT

Guard rail actuated safety apparatus (42, FIG. 1; 89, FIGS. 5A and 5B) is operative to prevent simultaneous lowering of both of a pair of guard rails (26, 28) to inoperative positions in which they are ineffective to prevent a patient from falling off the edge of a patient support assembly 12. In one embodiment, the guard rails are secured together by a cable (44) which holds the guard rails against concurrent lowering. In an electromechanical embodiment, a controller (89, FIG. 5) senses the guard rail (26, 28) position, and blocks the lowering of either guard rail (26, 28) whenever the other is lowered. In addition, or alternatively, the controller (89) actuates a brake 146, sounds an alarm (136), raises the guard rails (26, 28) after a time delay (158), deactuates a drive motor (118) for a movable or adjustable patient support assembly (12) or releases air from a pneumatic mattress (12A'). An attendant detector (141, 143, 138, 140) overrides actuation of the selected alarm condition responsive apparatus (146, 148, 150, 152, 154) and rail latch actuators (93, 95, 91, 97) when an attendant is detected alongside the bed (8).

75 Claims, 7 Drawing Sheets

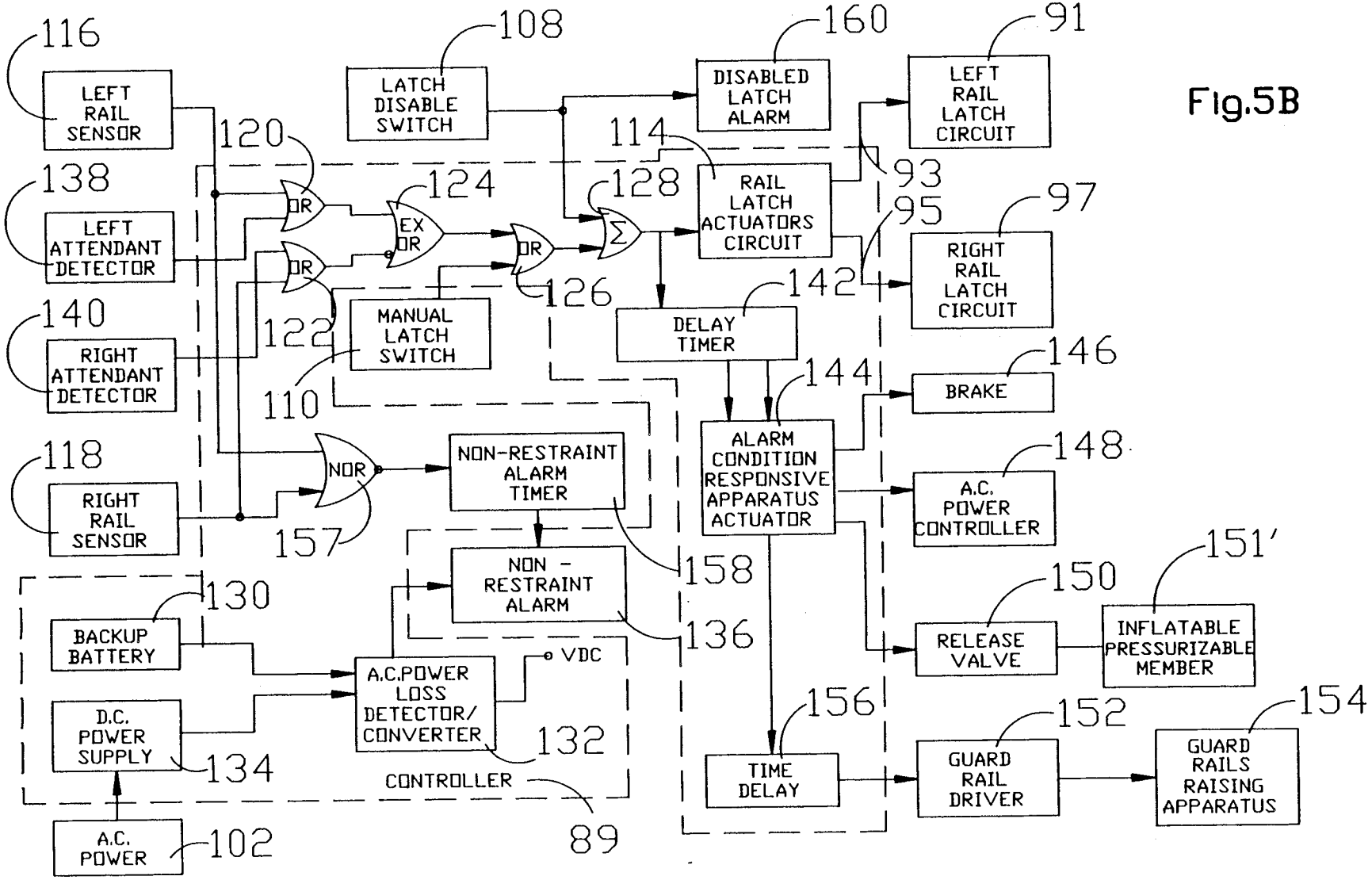
Fig.5B
LEFT RAIL LATCH CIRCUIT
RIGHT RAIL LATCH CIRCUIT
BRAKE
A.C. POWER CONTROLLER
RELEASE VALVE
GUARD RAIL DRIVER
INFLATABLE PRESSURIZABLE MEMBER
GUARD RAILS RAISING APPARATUS
DISABLED LATCH ALARM
RAIL LATCH ACTUATORS CIRCUIT
DELAY TIMER
ALARM CONDITION RESPONSIVE APPARATUS ACTUATOR
TIME DELAY
LATCH DISABLE SWITCH
EX OR
OR
MANUAL LATCH SWITCH
NOR
NON-RESTRAINT ALARM TIMER
NON - RESTRAINT ALARM
VDC
A.C.POWER LOSS DETECTOR/ CONVERTER
CONTROLLER
LEFT RAIL SENSOR
LEFT ATTENDANT DETECTOR
RIGHT ATTENDANT DETECTOR
RIGHT RAIL SENSOR
BACKUP BATTERY
D.C. POWER SUPPLY
A.C. POWER
91
93
95
97
102
108
110
114
116
118
120
122
124
126
128
130
132
134
136
138
140
142
144
146
148
150
151'
152
154
156
157
158
160
89

HOSPITAL BED WITH GUARD RAIL ACTUATED SAFETY APPARATUS

BACKGROUND OF THE INVENTION

This invention generally relates to safety features for a hospital bed with movably mounted guard rails and, more particularly, to guard rail actuated safety apparatus for reducing the risk of negligent use or non-use of the guard rails to prevent falling injuries to patients.

Conventional hospital beds are often provided with guard rails to prevent injuries to patients from falling out of bed. Such falling injuries can be serious, if not fatal. Catastrophic liability for the hospital or other health facility responsible for the good care of the patient can also result because of the high level of care which is legally expected of them. In addition, it is well known that the risk of serious injury caused by a fall from a hospital bed is greater for the typical patient in a hospital than for a healthy person. Hospital patients are often in a fragile condition and are less able to withstand even the slightest injury. The height of the top of the mattress of a hospital bed and thus the extent of the drop is significantly greater than in a conventional bed. Also, in order to facilitate ease of cleaning and rolling movement of beds and other equipment, many hospital floor surfaces are only thinly carpeted, if at all.

Such guard rails are often movably mounted to the bed frame to enable them to be lowered to an inoperative position. Movable mounting of the guard rails is required to facilitate access to the patient, to install and remove the patient and to periodically change soiled sheets, mattress covers, blankets and the like. There are numerous methods of movably mounting the guard rails to the bed frame which are known. Some guard rails are mounted to slide up and down, such as shown in U.S. Pat. Nos. 2,734,104 of Gollhofer issued Feb. 7, 1956 and 3,012,255 of Diehl issued Dec. 12, 1961; some are mounted for pivotal movement about an axis transverse to the elongate axis of the bed, such as shown in U.S. Pat. Nos. 3,336,609 of Taylor issued Oct. 15, 1974, 3,930,273 of Stern issued Jan. 6, 1976 and 3,840,917 of Taylor issued Aug. 22, 1967; and some are mounted for pivotal movement about an axis parallel to the bed such as shown in U.S. Pat. No. 4,509,217 of Therrien issued Apr. 9, 1985. Even though easily movable to an inoperative position, these guard rails are relied upon exclusively to protect the patient against falls off the bed.

Accordingly, potentially dangerous situations can develop when the movably mounted guard rails on a hospital bed are accidentally or inadvertently placed in, or allowed to remain in, a lowered, inoperative position. In some of these situations the guard rail is rendered or allowed to remain inoperable when it is most needed.

One dangerous situation potentially develops when the mattress covers or sheets of a bed with an immobile patient need to be changed. In such case, the patient is sometimes rolled onto his side away from the lowered rail, and the sheet is then loosened and tucked against the edge of the patient's body where it meets the mattress. The attendant then goes to the other side of the bed and rolls the patient onto his other side and off the tucked portion of the sheet to enable its removal. A new sheet is then installed in a reverse, but otherwise identical, fashion. During such a procedure, it is recommended for the attendant to only lower one side rail at a time and only while the attendant is standing at that side. However, if the attendant forgets or is not properly trained, it is possible for the attendant to actually roll the patient toward an unprotected edge of the mattress or to leave the side of the patient's bed in an unguarded condition.

In some situations, and often emergency situations, the bed, being mounted on wheels, casters or the like, is used to transport the patient from different locations in the hospital. During emergencies it is often necessary to lower one or both rails to gain access to the patient immediately prior to moving the bed. Again, although recommended procedure is to raise the guard rail to an operative position while the bed is being rolled across the floor, it is possible for the procedure to not be followed even though the momentum forces, such as caused from the bed being rolled around a corner or inadvertently being jammed against an object, increase the chances of the patient moving toward an unprotected edge of the mattress or other patient support.

The danger of a patient losing balance and falling toward an unprotected edge while sitting up in bed, for instance, is increased when the profile of an articulatd bed is being adjusted, lowered or raised or when a rotary kinetic therapy bed, such as shown in U.S. Pat. No. 3,434,165 of Keane, issued Mar. 25, 1969, is operated. Again, although the safest procedure is for both guard rails to be raised to an operative position by the attendant, the attendant may forget to do so or may not be present upon occurrence of the adjustment or other movement of the patient support.

It is also possible for a rail to fall into an inoperative position due to mechanical failure of a releasable rail locking mechanism or due to inadvertent or unintentional release of the guard rail by the patient. If an attendant forgets to raise the rail after administering a shot or the like, the patient can remain unprotected from falls off the edge of the bed while semiconscious or asleep.

While there has been an attempt to provide an alarm when a patient tries to crawl over the rails without lowering them, such as shown in U.S. Pat. Nos. 3,781,843 of Harrison et al., issued Dec. 25, 1973 and 4,067,005 of Levy et al., issued Jan. 3, 1978 for some time there has been no solution to the potentially severe risk presented to patients in hospital beds lacking any protection against negligent misuse of, negligent non-use of or accidental failure of hospital bed guard rails.

Several locks, such as shown in U.S. Pat. No. 3,846,854 of Bryant issued Nov. 12, 1974, and the alarm systems of the patents of Harrison and Levy et al., above, are directed against restraining the patient against lowering the guard rail or warning of the patient's attempts to climb over the guard rail. However, they fail to even address the equally serious and potentially greater risk to the patient and resultant liability from negligent use of the guard rail by attendants.

SUMMARY OF THE INVENTION

Accordingly, it is an object of the present invention to provide safety apparatus and methods of using same to reduce the risk of injury to a patient from falling out of a hospital bed caused by the inadvertent absence of guard rail protection due to accidental lowering of a guard rail or due to negligent or other inadvertent failure to maintain a guard rail in a position in which it is operative to prevent the patient from falling off the edge of the bed.

This objective is achieved in part through provision of apparatus which prevents lowering of both guard rails at the same time. In a preferred embodiment well suited for retrofitting to existing beds, electromechanically actuated stop members block lowering of either guard rail when the other guard rail is sensed as already being in an inoperative condition, under (a) any circumstances or (b) only if an adjustable or movable patient support is being changed, raised or lowered or reciprocally rotated or otherwise moved or (c) only if the one or more wheels are locked or engaged by a brake or (d) only after a preselected time period. In another embodiment well suited for inclusion as original equipment, the guard rails are mechanically linked together, such as by a cable fed through a pulley mounted to a frame, which prevents the lowering of either guard rail when the other rail is in a lowered position. Alternatively, a pair of blocking members are mechanically linked with the opposite guard rail.

The object of the invention is also achieved in part through provision of guard rail actuated safety apparatus which prevent translational movement of the bed when either or both of the guard rails is in an inoperative condition. In one embodiment, the rails or their releasable locking mechanisms are mechanically linked to a mechanically actuated brake on one or more of the wheels or casters upon which the bed is mounted. In another embodiment, the status of the guard rails is electrically sensed and an electromechanical or electromagnetic brake or locking mechanism is controlled to prevent translational movement when either or both of the guard rails are inoperative.

The objective is also achieved, in part, through provision of guard rail actuated safety apparatus to actuate alarm condition responsive means in the event of translational movement of the bed when either or both of the guard rails is in an inoperative position. In one embodiment, an actuator for an alarm is moved to a position in which translational movement causes it to make an alarm noise, and in another embodiment, the translational movement is electronically sensed and an electronic alarm is actuated. In one form of the invention, a time delay is provided before alarm actuation.

Once one or both of the guard rails is put in an inoperative condition, the longer it remains in that condition the greater the chance of the patient falling out of the bed due to fitful sleep or the like. Accordingly, the objective of increased safety is also achieved in part through provision of safety apparatus for sounding an alarm regardless of translational movement of the bed in response to one or more alarm conditions, such as when both guard rails are in an inoperative condition. Further, the sounding of an alarm when both guard rails are lowered will warn an attendant not to continue with such a dangerous procedure as lowering both guard rails.

The objective of increased patient safety is also achieved in part through provision of safety apparatus which functions to detect the presence or absence of an attendant alongside the guard rail to control the guard rails and to take patient protection measures in accordance with said detection. Improved safety is also achieved through provison of means to automatically raise the guard rails to an operative position. Preferably, this happens after a preselected time delay following detection of an alarm condition.

The objective is also partly achieved through provision of apparatus in which the movement of an adjustable patient support such as in an articulated adjustable bed or a continuously moving kinetic therapy bed is prevented when either or both of the rails are in an inoperative condition. In one embodiment, means for normally applying power to an electric alarm motor is disabled, and in another embodiment the mechanical linkage from the motor shaft is jammed or prevented from being applied to the patient support.

Increased safety is also achieved, in part, through provision of safety apparatus which prevents or disables pressurization of a pressurizable member of a therapeutic medical apparatus underlying the patient, such as a turning device or a therapeutic device for impinging the patient with small streams of air under pressure, when a guard rail is in an inoperative position.

The objective of improved patient safety is also achieved, in part, through provision of an attendant detector for disabling the various alarm condition responsive apparatus when an attendant is standing alongside an inoperative guard rail.

BRIEF DESCRIPTION OF THE DRAWING

The foregoing objects, features and advantages of the invention will be disclosed in greater detail and further advantageous features will be made apparent from the claims and the following detailed description of the preferred embodiments given with reference to the several figures of the drawing, in which:

FIG. 5B is a functional block diagram and schematic logic diagram the,, electromechanical embodiment schematically illustrated in FIG. 5A;

DETAILED DESCRIPTION

Figure 1:
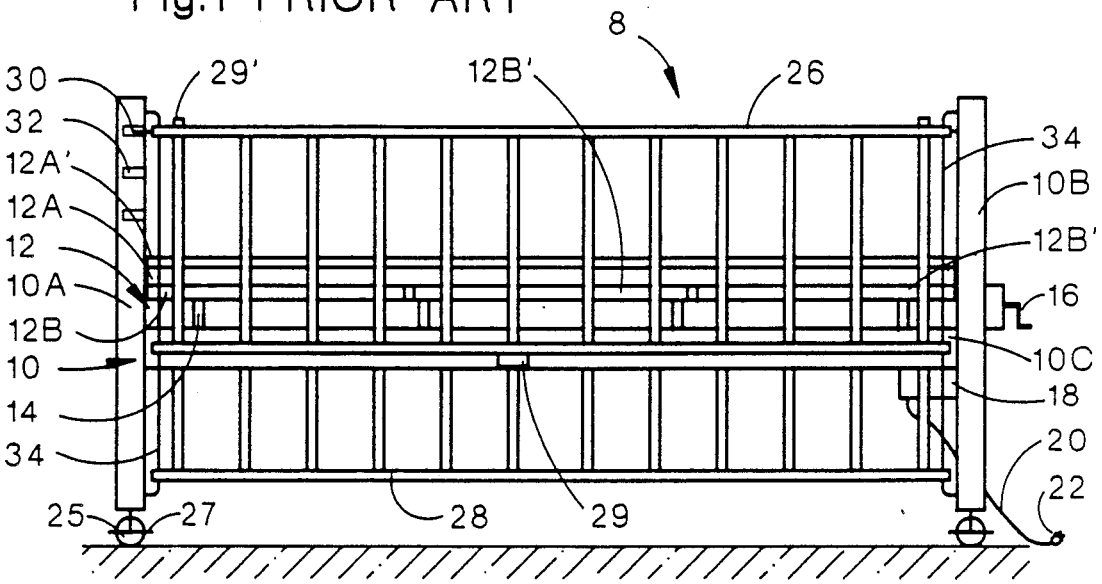
Fig.1 PRIOR ART
FIG. 1 is a schematic, side elevation view of a conventional, or prior art, hospital bed with one type of movably mounted guard rails.

Referring now to FIG. 1, as briefly described above, a conventional hospital bed 8 or the like is seen to include a main frame, or frame, 10 having head frame member 10A, foot frame member 10B and two elongate cross members 10C which interconnect the foot and head frame members 10A and 10B.

Supported by the frame 10 is a patient support assembly 12 including one or more conventional mattresses 12A, possibly, an optional overlying pressurizable member 12A' and an underlying patient support frame 12B. In some hospital beds, the patient support frame 12B is mounted to the frame 10 by means of movable linkage members 14 to selectively adjust the elevation, degree of tilt, or, in the case of an articulated frame having interconnected segments 12B', the relative angular position of these segments 12B'.

Power for this movement is obtained either through means of a mechanically operated hand crank 16 connected with patient support frame 12B and linkage members 14 which provides manual adjustment or through means of an electrical motor 18 connectable to an AC power outlet (not shown) through a power cord 20 and connector plug 22. The control for selecting and actuating the different types of possible movement of the patient support assembly 12 is generally contained in a control panel 24 at the foot of the bed. Alternatively, sometimes the controls are at the end of a cord (not shown) which is accessible by the patient.

The entire main frame 10 is also mounted to wheels 25 for facilitating translational movement of the bed 8 across a floor surface. Manually actuated brakes 27 are provided to prevent inadvertent translational movement of the beds.

Most importantly with respect to this invention, many conventional hospital beds 8 employ movably mounted guard rails, or side rails, 26 and 28 which are respectively mounted on opposite left and right sides of the patient support assembly 12. The guard rails 26 and 28 are mounted to the frame 10 for movement between an operative position, as illustrated by guard rail 26 in FIGS. 1 and 2, in which a significant portion of the guard rails 26 or 28 is above the elevation of the patient support assembly to significantly restrain the patient against lateral movement off the side of the patient support assembly 12 to a lowered, inoperative position, as illustrated by guard rail 28 of FIGS. 1 and 2. In the inoperative position there is no significant portion of the guard rail 26 or 28 above the elevation of the patient support assembly 12, and it effectively provides no or little restraint against a patient laterally sliding, rolling or crawling off the side of the patient support assembly 12. In certain circumstances, any position of the guard rail above this inoperative level or position can be preselected as a permitted operative position even though it is less than the highest level achievable.

Once the guard rail 26 or 28 is moved to its operative position, a guard rail latch, such as a spring loaded latch 29, is automatically actuated to latch the guard rails 26 and 28 in their operative positions. Preferably, the latch is inaccessible by the patient, as is latch 29 located beneath the patient support assembly 12. Alternatively or additionally, a latch is mounted at a location accessible by the patient, such as latch 29' which has movable spring biased pins 30 releasably slidable into pin receptacles 32 at different selected elevations along the frame member 10A.

There are basically two conventional means for movably mounting guard rails 26 and 28. The first way is to slidably mount the guard rail 26 to vertical poles 34 attached to the frame at opposite ends of the bed, as shown in FIG. 1. This type of mounting is also shown in U.S. Pat. Nos. 2,734,104 of Gollhofer and 3,012,255 of Diehl. Another conventional way of mounting such guard rails is to mount them for pivotal movement relative to the frame, and this mounting technique is well treated in U.S. Pat. Nos. 336,609 of Taylor; 3,840,917 of Taylor; 3,930,273 of Stern and 4,509,217 of Therrien. The guard rail 26 can, of course, also be mounted for releasable detachment from the frame 10 when it is moved out of an operative position. Generally, reference should be made to the patents for further background information on conventional hospital beds with guard rails.

It is not a problem to design latches, such as latches 29 or 29' of FIG. 1 or as shown in U.S. Pat. No. 3,846,854 of Bryant, which operate properly and effectively to prevent the guard rail from being lowered to an inoperative position when it is not desired to do so. However, there is no means which assures that once a guard rail 26 or 28 is intentionally unlatched and lowered to an inoperative position, that the physician, nurse or other attendant will remember to return the guard rail 26 or 28 to its operative position. Also, there is nothing which prevents an attendant from improperly and unnecessarily lowering both guard rails 26 and 28 to a patient endangering inoperative position. Also, there is nothing warning an attendant that a guard rail has been place in an inoperative position.

These problems are all solved or ameliorated in accordance with the various embodiments of the present invention by providing a guard rail actuated safety apparatus which electrically, mechanically or electromechanically linking the guard rails 26 and 28 to prevent both from being simultaneously rendered inoperative or to give warning of same.

Figure 2:
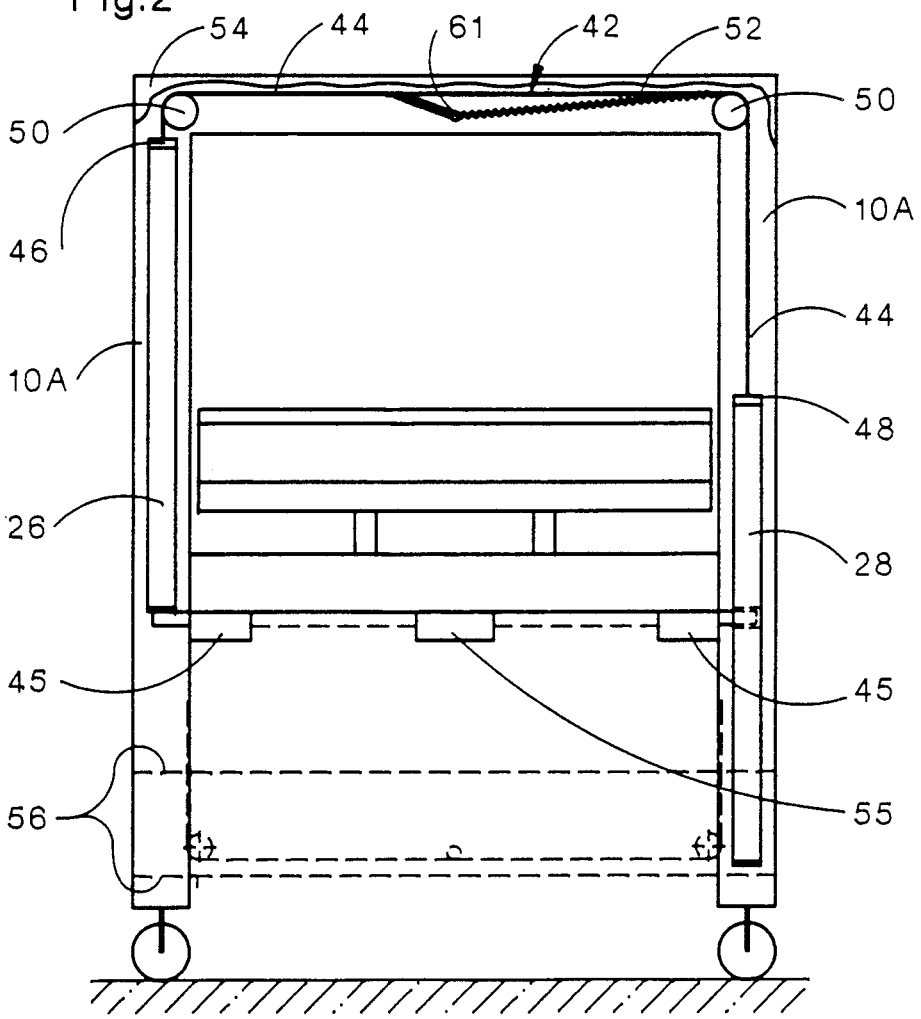
FIG. 2 is a schematic, end view illustration of a hospital bed incorporating one mechanical embodiment of the safety apparatus of the present invention employing a flexible cable.

In the first embodiment shown in FIG. 2, a guard rail actuated safety apparatus 42 mechanically links the left guard rail 26 with the right guard rail 28. In its simplest form, the linkage apparatus 42 comprises an elongate flexible cable 44, a connector 46 for connecting one end of the cable to the left guard rail 26, a connector 48 for connecting the other end of the cable 44 to the right guard rail 28 and means for mounting the cable 44 to the frame 10 for movement relative to the frame 10, such as guide members 50 and a slack remover assembly 52. The guide members 50 establish a guided path along which the cable 44 must travel. As seen in FIG. 2, the length of the cable 44 relative to the length of its guided path is selected to prevent both guard rails 26 and 28 being concurrently lowered to an inoperative position.

If, for instance, the left guard rail 26 is lowered despite the right guard rail 28 being in an inoperative position, the lowering force applied to the left guard rail 28 is transmitted through the cable 44 to raise the right guard rail 28. In such case, both guard rails 26 and 28 can be placed in an operative positions in which they are both at elevations which are intermediate the wholly inoperative position (in which no portion is elevated above the patient support assembly) and a maximum operative position (in which they are at an elevation lower than the highest level operative position) such as the position of the left guard rail 26 shown in FIG. 2. Alternatively, the left guard rail 26 is locked in position or the force is employed to cause the right guard rail to jam and to prevent any lowering of the left guard rail 26 from its fully operative position. A slack removing assembly or slack remover, 52 is preferably provided to remove any slack in flexible cable 44 when both guard rails are in an elevated, operative position.

Preferably, the guide members 50 and the slack remover assembly 52 and the portion of cable 44 therebetween are contained within a sheet metal or plastic housing 54 which is mounted to the top of frame 10A. At least two points of the guiding means, such as two guide members 50, should be at an elevation above the highest elevation of the guide rails 26 and 28. Alternatively, the slack remover assembly 52 and housing 54 are mounted below this elevation, even beneath the patient support assembly, such as location 56 shown in broken line. However, in such a case, the cable 44 is routed upwardly to guide members 50 or the like. In such case the guide members 50 are preferably in the form of pulleys or low friction posts located at opposite sides of the patient support and located above the highest elevation. If the frame members 10A are tubular, then the cable 44 is routed through the frame member and the guide members, or pulleys, 50 are mounted within the tubular frame member to provide for a neat clean appearance and for protection of the apparatus and the patient. Alternatively, a special tubular housing, is added for this purpose.

Figure 2A:
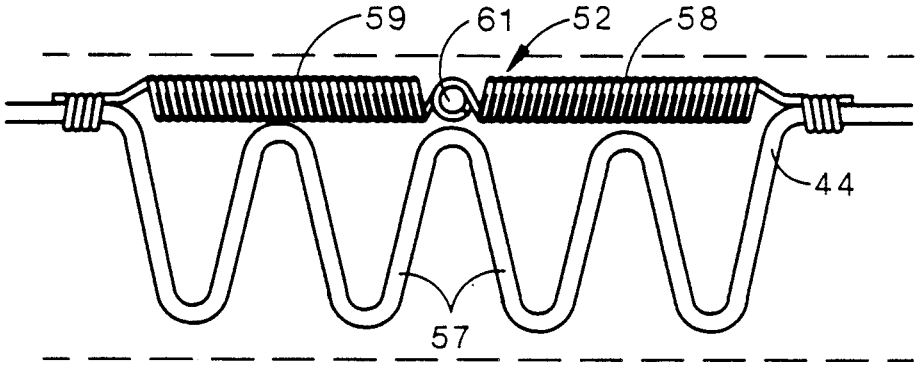
FIG. 2A is an enlarged schematic illustration of a slack removal assembly of the safety apparatus of FIG. 2.

Referring now also to FIG. 2A, when both guard rails are in an elevated, operative position at their highest level, such as left guard rail 26 shown in FIG. 2, slack 53 in cable 44 is created. This slack 57 is preferably drawn into the housing 54 by the slack remover 52 which includes a pair of coil springs 58 and 59. Each of these coil springs 58 and 59 have one end secured to a post 61 located intermediate guide members 50, such as shown in FIG. 2.

Alternatively, cable 44 is made of material or has a section made of resilient material which allows the cable to stretch only to a maximum length equal to the length of the guide path between one full raised and one lowered guard rail, but which will shrink in length sufficiently when both guard rails are in an operative position to eliminate slack. While it is preferred to provide such slack removal or gathering means to achieve a neat appearance and smooth and quiet operation, it is not necessary to achieve the primary objective of preventing simultaneous lowering of both guard rails.

Figure 2B:
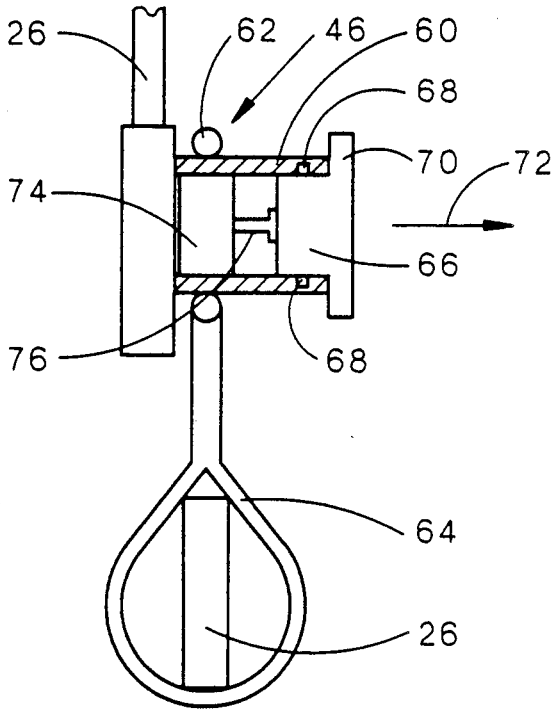
FIG. 2B is an enlarged schematic illustration of a quick release cable connector of the mechanical embodiment of FIG. 2.

Referring now to FIG. 2B, the cable connectors 46 and 48 preferably include means for quick release of the cable 44 from the guard rails 26 and 28. This feature is provided to enable the concurrent lowering of both guard rails in case of an emergency which requires clear and immediate access to the patient from both sides of the bed. Such concurrent lowering may also be needed to change mattresses, cleaning and maintenance.

In the embodiment of FIG. 2B, the quick release connector 46 carries a post 60 which is slideably received within a mating female connector 62. Female connector 62 is fixedly or, again, releasibly, secured to an upper portion of the guard rail by a loop connector 64 or any other suitable connector. The post 60 and female connector 62 are normally held in mating relationship by a quick release locking member 66. Locking member 66 carries pins 68 which extend laterally into mating holes within a bore in post 60 in which the locking member is received in locked relationship therewith.

The pin 68 is preferably retracted in response to a blow to a head section 70 of locking member 66 in the direction of arrow 72 though means of a suitable pivot member linkage therebetween, but any other means of retracting the pin which is also secure against patient actuation will suffice. Once the pins 68 are retracted, the locking member 66 is readily removable from within the bore in male member 60. Once removed, the female connector 62 and the male member 60 can be easily separated to disconnect the linkage between the guide rails, so both can be lowered. For greater security, key release locks are used with only authorized personnel given keys.

As an alternative to emergency lowering of both guard rails, the cable 44 is provided with means for carrying additional length in a coiled, resiliently retracted, or folded condition to enable concurrent lowering of both guard rails and means for selectively releasing the additional length in case of emergency.

It is considered that disablement of the guard rail actuated safety apparatus is a potentially dangerous condition. Accordingly, a battery or mechanically powered audible alarm or alarm signal telemetry device 74 should be provided which gives an alarm indication whenever the locking member 68 is separated from the male connector 60. Separation is detected by a suitable alarm sensor 76 protectively mounted within the bore in male member 60, such as a limit switch or proximity switch or mechanical lever.

Figure 2C:
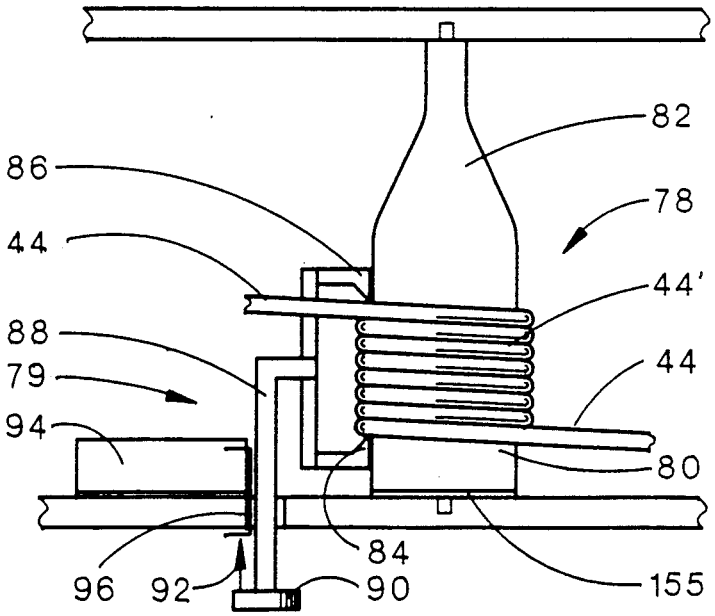
FIG. 2C is a schematic illustration of a quick release device useable with the mechanical embodiment of FIG. 2.

Another way of dealing with slack is shown in FIG. 2C in which a dual diameter pulley 78 is provided in place of the guide members 50. The dual diameter pulley 78 has a relatively larger diameter section 80 about which the additional length 44' of cable 44 is normally coiled and a relatively smaller diameter section 82. A stripper assembly 79 is designed to selectively move the additional length back and forth between the larger and smaller diameter sections 80 and 82 to provide lesser or greater available length to cable 44. The stripper assembly 79 has a pair of telescopic spring loaded stripper arms 84 and 86 which resiliently press against the surface of the pulley 78' and are carried at the end of an arm 88. Arm 88 is mounted for slideable movement between its normal position, as shown in FIGS. 2C, with the additional length 44' coiled around the larger diameter section 80, and the emergency release position in which the additional length 44' has been slid over to the smaller diameter section 82 in which an adequate portion of the additional length 44' is released to enable both guard rails to be lowered. Release is effected by moving pulley release actuator 90 in the direction of arrow 92.

Preferably, an alarm 94 is actuated when its sensor arm 96 is engaged by actuator 90. Alternatively, a mechanical, spring loaded alarm 155 is linked with the release mechanism and automatically actuated when the release mechanism is actuated or both guard rails are lowered to an inoperative position.

Also, preferably, the cable release mechanism comprises the same coiling spool as used for slack removal but which also has o the additional length 44' wound therearound and means for blocking rotation to release such additional length 44' unless manually actuated by movement of a locking member to a slack release position. However, slack removal and quick release features may be provided separately.

In addition, preferably, actuation of the release mechanism of FIG. 2C requires a key which is only given to persons who have been trained to be fully cognizant of the dangers of having both guard rails in a lowered position. If a mechanical alarm is employed, it preferably uses a main spring to power it which is wound tight by the unwinding of the additional length of cable. A mechanical alarm will eventually wind down and stop, but if an electrically powered alarm is used instead, then means should be provided for disabling the alarm by authorized personnel when appropriate.

As noted above, an alternative to providing slack removal assembly 52 in combination with a relatively inflexible cable 44, is to make the cable 44 from resilient material. This eliminates slack, so the coiling spool assembly is replaced with a simple guide member 50 or pulley. In such case, the resilient cable, in its unflexed state, is of a length relative to the guide path which is sufficient to extend between the guard rails 26 and 28 when they are both in their manually elevated operative positions. In addition, the flexible cable has just enough resilience to stretch just the additional distance needed to lower one but not both of the guard rails 26 and 28 to an inoperative position.

In another form of this embodiment shown in FIG. 2, the cable 44 of FIG. 2 is made of material or constructed with sufficient resilient strength to raise both guard rails to an operative position unless prevented. A timed release locking mechanism 45 is used to lock each of the guard rails in a lowered, inoperative position. Preferably, the automatic lock release employs a spring powered mechanical timer which automatically releases the lock at the end of a preselected time period, such as ten seconds to five minutes. At the end of the time period, the lowered guard rail is automatically raised to an operative position by the power of the resilient cable 44. Dash pots or equivalents are employed, if necessary, to control the rate at which the guard rails are raised. Preferably, an alarm 55 is also actuated to give warning of the impending raising action. Preferably, the main spring (not shown) of the timer is wound, or powered, by the movement of the locking mechanism 45 into the locked position. Alternatively, the timed released locking mechanism is automatically released in response to an electronic timer. In any event, in the case of an attendant forgetting to raise the guard rail to an operative position, the rail will be automatically raised to that position to reduce risk to the patient due to such inadvertence.

Figure 3:
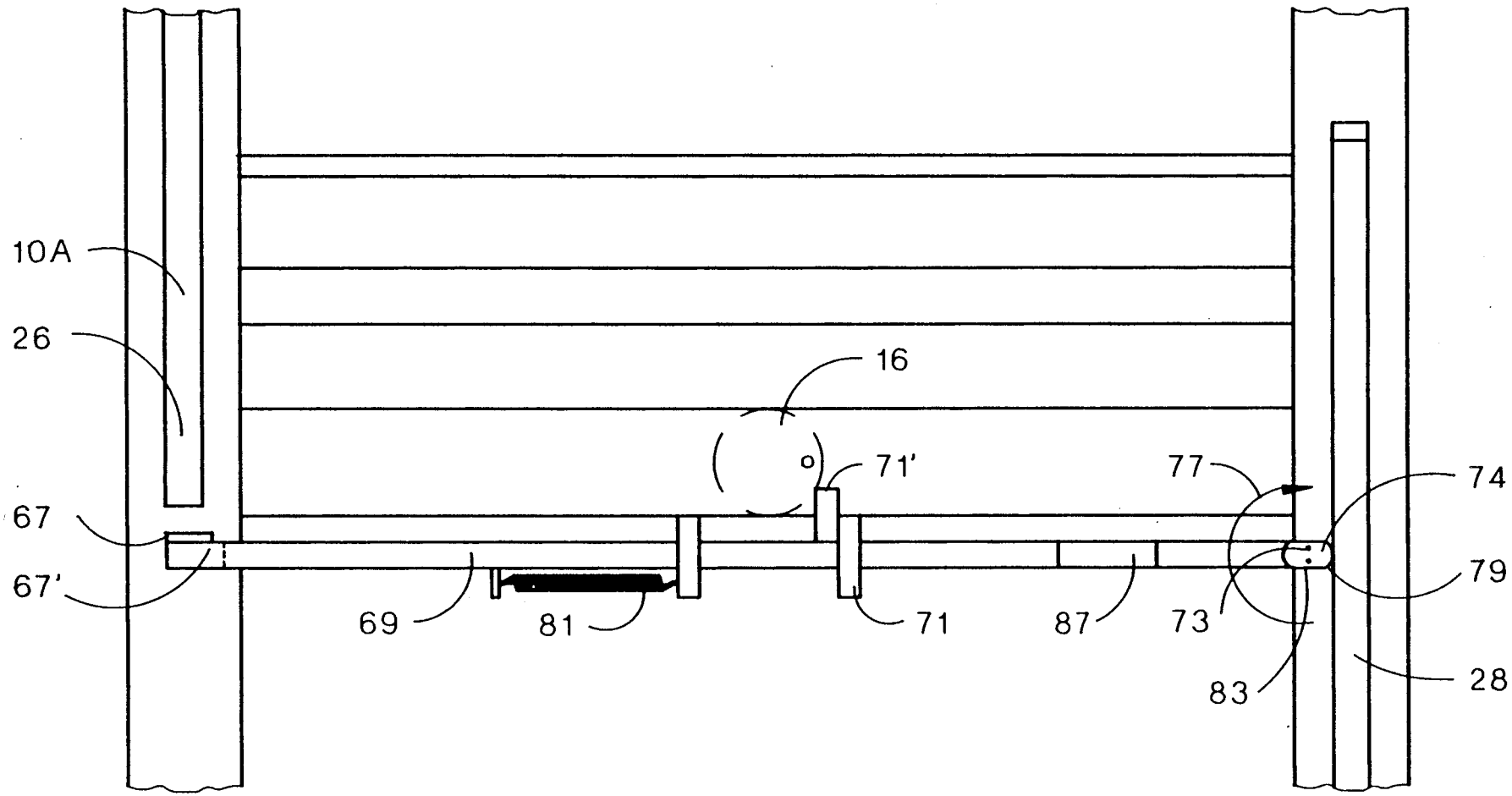
FIG. 3 is a schematic, cross sectional end view of a hospital bed incorporating another mechanical embodiment of the safety apparatus of the present invention.

Referring to FIG. 3, another purely mechanical form of the safety apparatus is shown in which blocking members, such as a blocking member 67 associated with guard rail 26, is automatically moved into a blocking, or latched position, such as blocking member 67 underlying guard rail 26. This prevents movement of the guard rail 26 into an inoperative position when the opposite guard rail, such as guard rail 28, is placed in an inoperative position. The automatic movement is achieved through means of a lineage assembly 69 which is connected to the blocking member 67 at one end and mounted to the frame 10 for movement when the other end is engaged by the opposite guard rail 28 being moved to an inoperative position, as shown in FIG. 3. This linkage assembly 69 includes one or more guide members 71 fixedly mounted to frame member 10C and a pivot axle 73 mounted to frame members 10A or 10C.

The pivot axle 73 mounts a link 74 for pivotal movement about axle 73 in a direction indicated by arrow 77 when the lowermost edge of guard rail 28 engages a camming edge 79 mounted to the distal end of link 74. A bias spring 81 returns the link assembly 67 to a non-blocking position shown in broken line 67' when the camming edge 79 is not engaged by the guard rail 28 in the position shown. Alternatively, linkage 69 carries a blocking member 67' which interacts with a latch 67'' to block it from being moved to an unlocked position. The link 74 is pivotally connected by means of a pivotal connector 83 to linkage assembly 69 extending across the bed and supported to the frame member 10C by means of guides 71. When the guard rail 28 is raised out of engagement with the camming edge 79, link 75 rotates in a direction opposite to that of arrow 77, the linkage assembly is caused to slide toward the guard rail 28 and the blocking member 67 is carried to a non-blocking position indicated by broken lines 67'.

In another form of this embodiment, the linkage assembly 69 is used indirectly to block unlocking of a latch mechanism which latches the guard rails in their operative position. In both embodiments, linkage assemblies 69 are provided for each of the guard rails. In addition, a releasible adjustment mechanism 87 for adjusting the effective length of link 69 is provided to selectively allow both rails 26 and 28 to be lowered when appropriate.

Another mechanical form of this safety apparatus includes a preventing means or jam member 71' which can engage and block hand crank 16 from being turned to adjust the articulated bed. This jam member 71' is mechanically linked to linkage assembly 69 whereby when either guard rail 26 or 28 is down or inoperative, jam member 71' is moved into a jam position with hand crank 16 preventing manual adjustment of the actuated bed.

Figure 4:
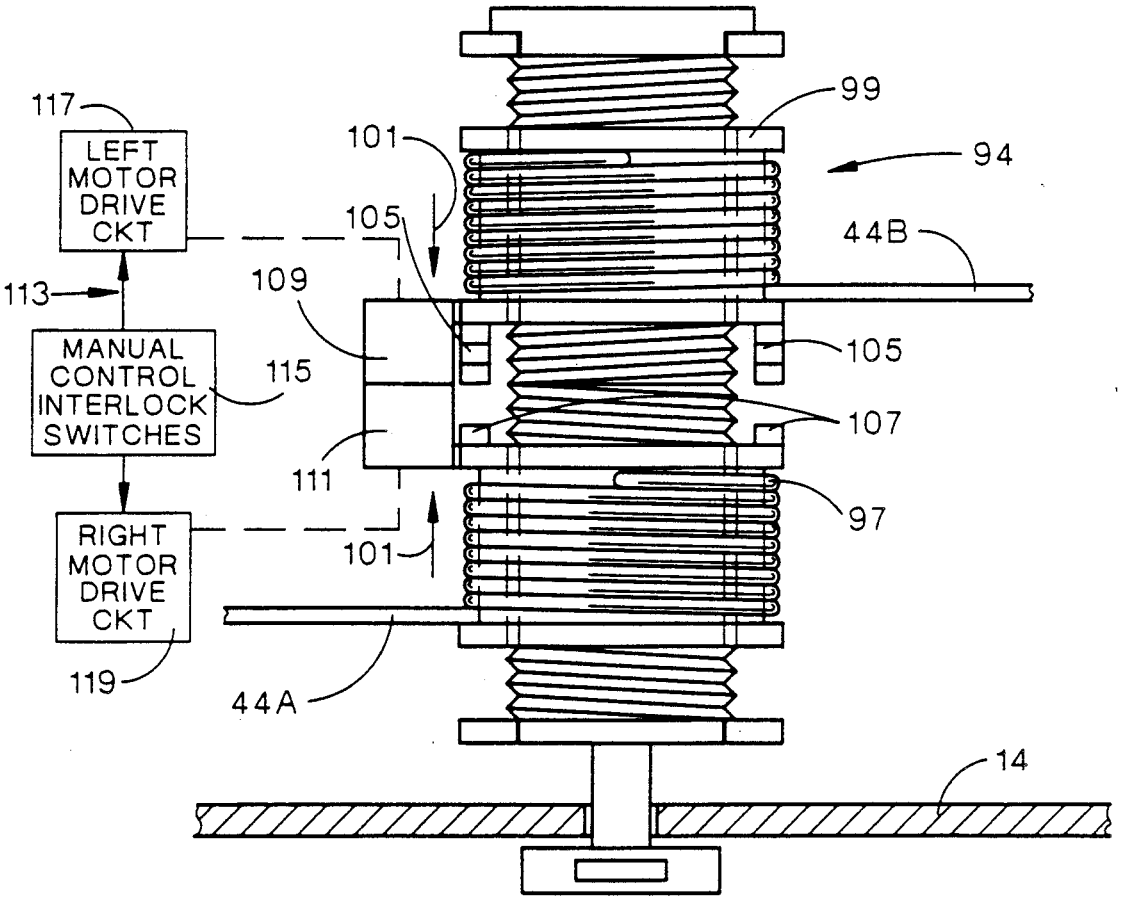
FIG. 4 is a schematic illustration of another electromechanical embodiment similar to the mechanical embodiment of FIG. 2 but in which the linkage between the rails is through means of a powered, rotary member to raise or to allow lowering of the guard rails.

Referring to FIG. 4, in another purely mechanical embodiment of the guard rail actuated safety apparatus, a coiling spool assembly 94 employs a pair of cable segments 44A and 44B respectively wound about a pair of spools 97 and 99 which are interlockable to prevent one from uncoiling when the other is already uncoiled. The distal ends of the two sections 44A and 44B are respectively connected to the pair of guard rails 26 and 28. Spools 97 and 99 are mounted to a pair of coaxially aligned threaded members. Spool 99 carries a pair of adjustable length locking members 105 which are aligned with mating fixed or adjustable locking members 107 mounted to the oppositely facing end wall of spool 97. The threaded members are threaded in opposite directions and the coiled sections 44A and 44B are wound in opposite directions.

Accordingly, when either coil section 44A or 44B is unwound, the associated spool 97 or 99 turns around its associated threaded member and moves laterally along the length of the associated threaded member in the direction of arrows 101 unless, or until, further rotation is blocked by mating engagement of locking members 105 of spool 99 and locking members 107 of spool 97. The point at which this blocking occurs is, of course, dependent in part upon the length of protrusion of the locking members 105 and 107 from their ends of spools 97 and 99. These lengths are selectively adjusted to achieve locking at a preselected level of the guard rails 26 and 28. Preferably, the length of the locking members is adjusted to achieve blocking engagement of the locking members when either spool has been sufficiently unwound to lower its guard rail to a fully lowered, inoperative position. In keeping with the above aspect of the invention, it will be appreciated that placement of both guard rails at half of their maximum elevation is possible.

Alternatively, an intermediate pivot interlock member not shown) is tripped into a fully locked position in blocking engagement of one of the locking members in response to engagement by one of the other locking members therewith. When one of the guard rails is lowered, the interlock mechanism blocks the coiling spool associated with the opposite guard rail from rotating and thereby blocks the lowering of the associated opposite guard rail to an inoperative position.

In an electromechanical form of this double spool embodiment, each spool is driven by a servo motor 109 and 111 to automatically raise and lower the associated guard rail 26 or 28 to an operative position in response to signals from an electrical controller 113. The controller 113 preferably includes manual control interlocked input switches 165 for selectively controlling the movement of guard rails 26 and 28 through actuation of left and right motor drive circuits 117 and 119, respectively. However, a conventional electronic or mechanical interlock prevents the controller from generating signals which would allow concurrent lowering of both guard rails 26 and 28 to an inoperative position. In addition, or alternatively, a sensor switch automatically actuated by the lowering of one of guard rail 26 or 28 causes the servo motor of the other guard rail 28 or 26 to be energized to raise the opposite guard rail 28 or 26.

In addition, preferably, the controller 113 includes a timer, means for initiating the start of a preselected time period in response to the lowering of one of the guard rails and means for automatically actuating the associated motor 109 or 111 to raise the guard rail to an operative position at the end of the time period.

Figure 5A:
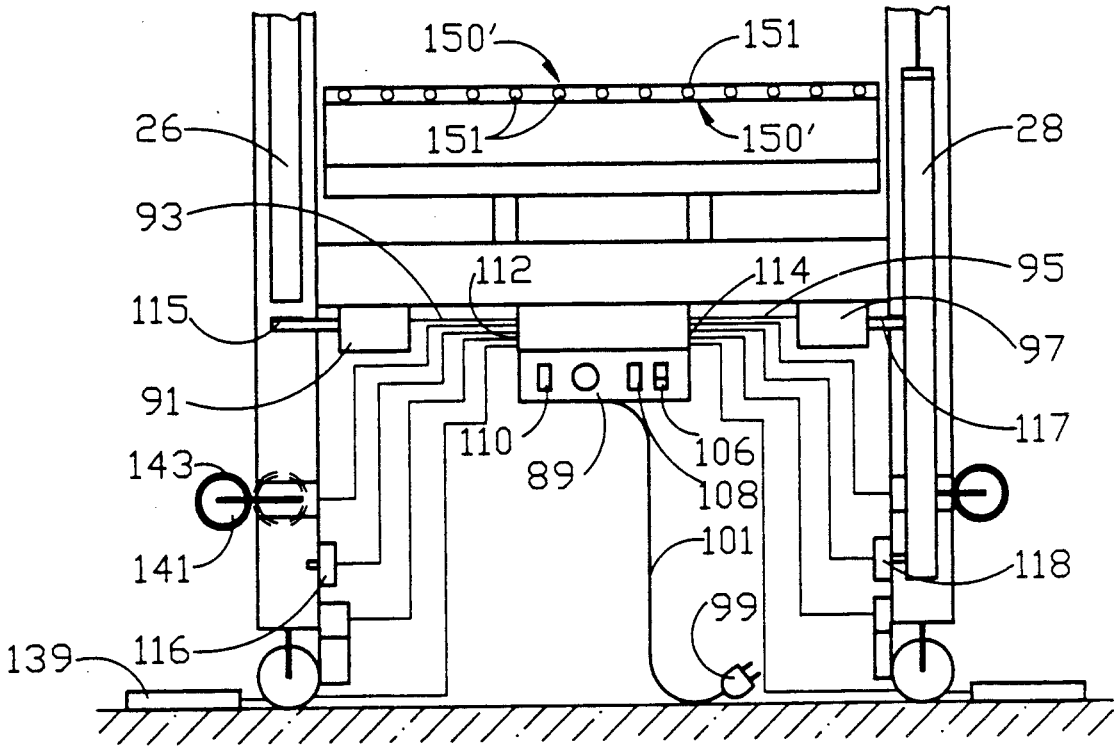
FIG. 5A is a schematic sectional end view of an electromechanical embodiment of the safety apparatus invention.

Referring now to FIGS. 5A and 5B, another embodiment of the safety apparatus is shown which employs electrically actuated blocking, or latch, members 115 and 117 which are selectively moved into blocking or non-blocking positions in accordance with the status of one or more electrical input terminals of a guard rail controller 89. Left rail latch circuit, or solenoid 91 and right rail latch circuit, or solenoid 97 respond to output signals on leads 93 and 95 to slideably move latch members 115 and 117 to a blocking position, as illustrated by blocking member 115 in FIG. 5A, and a non-blocking position, as illustrated by latch member 117 in FIG. 5A.

The controller includes an AC power plug 99 and cord 101 for connecting it to a suitable source of AC power 102, FIG. 5B. In the case of a bed of the type having a patient support adjustable into different positions by means of the electrical motor 18 or which is inflated or otherwise powered by the electrical motor 18, electrical AC power is provided to the motor 18 by means of leads from the controller 89. In such case, the inputs to the controller 89 include a power on/off switch 106 in addition to a key, or code, operated latch disable switch 108 and a manual latch switch 110. In addition, the controller 89 has one or more devices for selectively adjusting the time period of one or more time delay circuits. Preferably, the controller 89 also has one or more light indicators for indicating status of the latch disable switch 108, AC power and other like conditions.

In addition to the manual inputs, controller 89 has a plurality of inputs which receive signals automatically from remote sensors. Foremost, the controller 89 has a pair of inputs 112 and 114 which are respectively connected to the outputs of a left rail sensor 116 and a right rail sensor 118. When the right rail sensor 118, such as a photodetector or mechanical limit switch, is actuated by the presence of the guard rail 28 being in an inoperative position, such as shown in FIG. 5A, it generates a detection signal. The left rail sensor 116 likewise generates a signal in response to the left guard rail 26. The elevation of both sensors is adjustable to adjust the selected level associated with an inoperative position.

Referring to FIG. 5B, these detection signals are respectively coupled through suitable binary logic gates, such as OR-gates 120 and 122, exclusive OR-gate 124, OR-gate 126 and an AND gate 128 to a rail latch actuator circuit 114. In a preferred embodiment, when a detection signal, is provided by either of the left or right rail sensors, or switches 116 and 118, but not both, an actuation signal is applied by AND gate 128 to cause the rail latch actuators circuit to actuate both solenoids 91 and 97.

Preferably, the actuation of the solenoids 91 and 97 is achieved through de-energization, so that the guard rails 26 and 28 are placed in a locked position in the event of power loss. Alternatively, if a back-up, battery 130 is provided, an AC power loss detector/converter or another sensor 132 and a DC power supply 134 are used to energize the solenoids 91 and 97. When AC power is lost, the AC power loss detector/converter 132 switches to the back-up battery 130 to provide DC supply voltage VDC to the remaining circuitry, including a nonrestraint alarm 136.

In keeping with another important aspect of the present invention, the controller 89 also receives input signals from a left attendant detector 138 and a right attendant detector 140, FIG. 5B. When either of these detectors 138 and 140 are actuated by the presence of an attendant alongside the left or the right of patient support assembly 12, then the OR-gates 120 and 122 respectively associated therewith are disabled from generating a detection signal, or alarm condition signal, in response to the associated left rail sensor 116 and right rail sensor 118. Thus, if an attendant actuates the left attendant detector 138, the controller will function the same way as it would if the left guard rail 28 was in an operative position even if it is placed in an inoperative position.

Referring to FIG. 5A again, in one embodiment the attendant detector 138 and 140 are simply floor mounted switches, such as switch or electromechanical switch 139 which is connected to the frame of the bed which the attendant stands on while lowering the associated guard rail which activates an actuator. In another embodiment, a proximity sensor is provided with the use of infrared photosensors 141 and light sources 143 create a light or beam alongside the patient support which is broken when an attendant is present. These are mounted for movement to an inoperative position, as shown in broken line in FIG. 5A.

If the associated guard rail is left in an inoperative position after the attendant leaves the bedside, the OR-gate 120 or 122 will again cause the rail latches 90 and 92 to be actuated. In addition, after a preselected time delay provided by delay timer 142, or immediately, corrective patient protection measures are taken. All or any combination of these measures are also selectively taken whenever the guard rail latch actuators 141 respond to an alarm condition signal from AND-gate 128.

Thus, the output of AND gate 128 is coupled through delay timer 142 to one or more alarm condition responsive apparatus actuators 144. The actuators 144, in turn, actuate one or more of a brake 146, one or more AC power controllers 148, a release valve 150, and a guard rail driver 152 which, in turn, actuates a guard rail raising apparatus 154, such as disclosed above with reference to the coiling spool assembly 52 of FIG. 2C. The brake 146, when actuated, prevents translational movement of the bed across a floor surface when either of the guard rails 26 or 28 are inoperative. Examples of brakes of this invention are shown in FIGS. 6A, 6B, 7 and 8A and 8B, and described below.

The AC power controllers 148 are connected to one or more electrical motors, such as motor 104, for changing the elevation or angular position of the patient support assembly 12. In the case of an inflatable member being pressurized by means of an electrical motor, the AC power cord of the motor is releasibly connected to an AC receptacle to receive its power through AC power controller 148. Generally, the AC power controllers function to terminate power to the pressurizing motor or adjustment motor which gives movement to the articulated frame whenever an alarm condition is being detected. The AC power controllers can also initially prevent sending power to electric motors to pressurize inflatable member 150' by actuator 144 receiving signal from sensors 116 or 118 that one of the rails is inoperative.

The release valve or means for depressurizing 150 is actuated to vent an inflatable, or pressurizable, member 151' underlying the patient, such as an inflatable turning device, or a therapeutic air mattress which directs streams of air to a patient, when operating. This pressurizable member 150' as seen in FIG. 5B is depressurized when at least one of the guard rails is in an inoperative position which is sensed by rail sensors or means for sensing 116 and 118. Once a rail is sensed in an inoperative position, responsive means or AC power controller 148 actuates release valve or means for depressurizing 150 to depressurize pressurizable member 151'.

The pressurizable member 150' has holes 151, as seen in FIG. 5A, which permits impingement of pressurized air against a patient's body. The means for pressurizing the member 150' is an electric motor. The member can be depressurized when a rail is in an inoperative position by a means for deactuating the pressurizing means or AC controller 148.

Further, depressurizing means or valve 150 as seen in FIG. 5B can selectively vent either of at least a pair of inflatable members 150' as shown in FIG. 5A, by having a release valve for each member.

The guard rail driver 152 comprises a circuit for energizing the servo motors connected to coiling spool assembly 52, FIG. 2C, as described above, to automatically raise the guard rails to an operative position. This action is selectively taken only after another preselected time delay period, after lapse of the delay of timer 142, through provision of a separate time delay circuit 156. Alternatively, separate time delays are provided for each of the other alarm condition responsive apparatus.

In keeping with another important aspect of the invention, the nonrestraint alarm 136 is caused to provide an alarm condition only in response to both guard rails 126 and 128 being sensed in an inoperative position. This occurs immediately in response to a double alarm signal from a NOR gate 157 or only after a preselected time period provided by a nonrestraint alarm timer 158. The NOR-gate 157 has two inputs respectively coupled to the left guard rail sensor 116 and right rail sensor 118. When both sensors provide a detection signal, NOR-gate 157 generates an alarm signal. Alternatively, the two inputs are connected to the outputs of OR-gates 120 and 122.

When the latch disable switch alarm disabling means 108 is actuated, the AND gate 128 is disabled from providing an alarm condition signal to the rail latch actuator 158 and the alarm condition responsive apparatus actuators 114. However, in such event, a disabled latch alarm circuit 160 is actuated to provide a continuing indication of same.

The manual latch switch 110, on the other hand, causes generation of an alarm signal by OR-gate 126 regardless of the condition of the exclusive OR-gate 124.

Figure 6A:
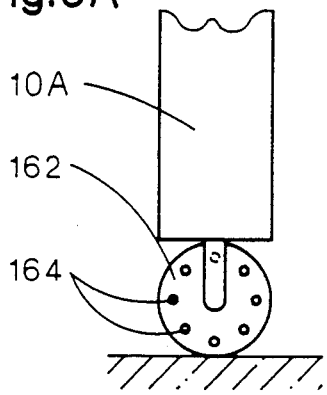
FIGS. 6A and 6B are schematic, side and end view illustrations of an electromechanically actuated brake which is employed in accordance with the present invention.
Figure 6B:
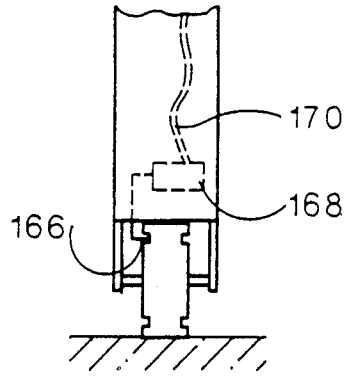

Referring now to FIGS. 6A, 6B, 7 and 8A and 8B, brakes previously shown only as functional blocks 146, are now shown in detail. In FIGS. 6A and 6B, the bed frame members 10A are mounted on special wheels 162 having locking pin holes 164. The pin holes 164 are mounted for receipt of a pin 166 which is moved into one of the holes to lock the wheel by means of a solenoid 168 connected to the alarm condition responsive apparatus actuator 144 through leads 170.

Figure 7:
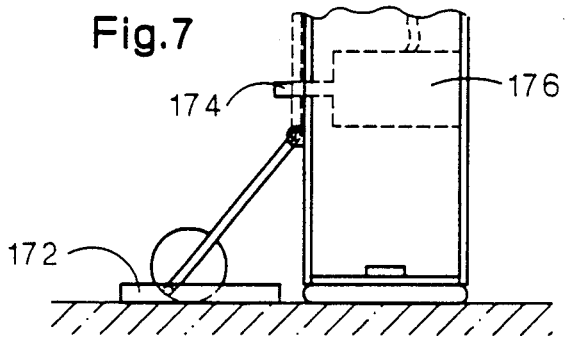
FIG. 7 is a schematic, side view illustration of another embodiment of a brake illustrated in functional block form in FIG. 4B.

In FIG. 7, a brake shoe 172, is spring loaded to move to a position engaging the floor, as shown, when it is released by means of a holding arm 174 moved by means of a solenoid 176. A wheel carried with the shoe 172 has means to sound an alarm when the bed is moved along the floor despite the engagement of the brake shoe 172 with the floor.

Figure 8A:
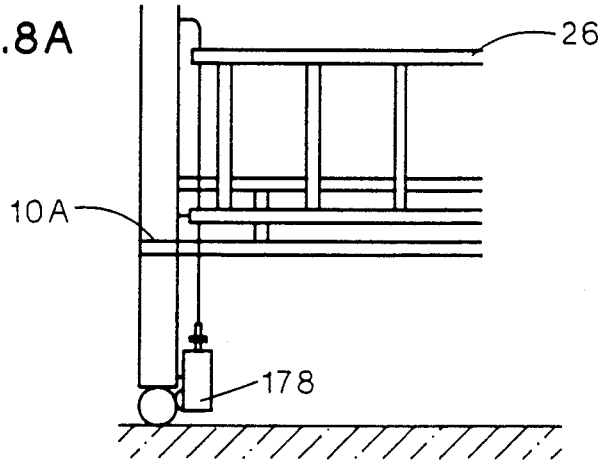
FIGS. 8A and 8B are side views of hospital beds employing the safety apparatus of the present invention in which a brake is automatically, mechanically actuated to restrain against translational movement of the bed whenever at least one of the guard rails is in an inoperative position, FIG. 8A showing the brake in its non-actuated position when the associated guard rail is in an operative position and FIG. 8B illustrating the brake engaged through mechanical interaction with the guard rail when it has been lowered to an inoperative position.
Figure 8B:
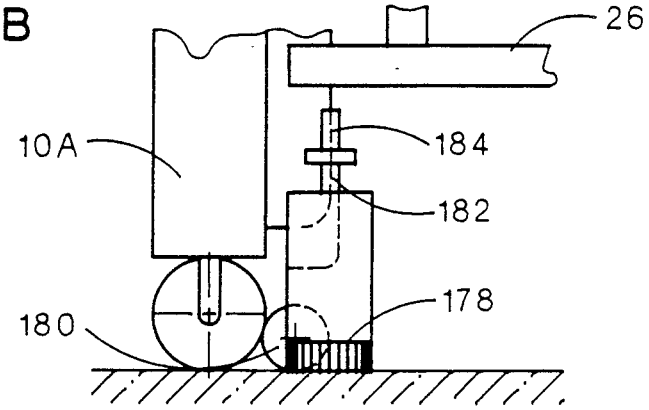

In FIGS. 8A and 8B, a purely mechanical automatic braking system is shown in which a brake member 178, is normally spring loaded to an inoperative position, but is automatically pushed downward into an operative, floor engaging position, as shown in FIG. 8B, when the associated guard rail is lowered to an inoperative position. A wheel 180 is provided to make an alarm noise if the bed is translated despite the engagement of brake member 178. A linkage member 184 which is engaged by the guard rail, such as guard rail 26, is adjustable in length to selectively adjust the inoperative position at which the brake member 178 is engaged.

While particular embodiments have been disclosed for purposes of illustration, it should be appreciated that many variations are contemplated which are within the scope of the appended claims. For instance, if pivotally mounted guard rails are used, the apparatus for raising and blocking their movement will necessarily be different than that shown, but the principle will remain the same. Also, not all the features of the invention need be used together as they possess independent benefits for patient protection.

I claim:

1. In a hospital bed having a frame, a patient support assembly mounted to the frame, a pair of left and right guard rails on opposite left and right sides of the patient support assembly and means for mounting the guard rails to the frame for movement between relatively inoperative and operative positions in which they are relatively less and more effective to restrain the patient against lateral movement off the side of the patient support assembly directly associated therewith, the improvement being a guard rail actuated safety apparatus, comprising:

means directly associated with the left guard rail for preventing movement of the left guard rail to a relatively inoperative position when the opposite right guard rail is in a relatively inoperative position; and means directly associated with the right guard rail for preventing movement of the right guard rail to a relatively inoperative position when the left guard rail is in a relatively inoperative position.

2. The hospital bed of claim ,1 in which both of said guard rail movement preventing means, include means for mechanically interconnecting the left guard rail with the right guard rail.

3. The hospital bed of claim 2 in which said interconnecting means includes an elongate flexible member having a pair of opposite ends, means for connecting one of said opposite ends to the left guard rail, and means for connecting the other of said opposite ends to the right guard rail.

4. The hospital bed of claim 3 in which said safety apparatus includes means for mounting said flexible member to said frame for guided, sliding movement relative thereto at a location above the patient support assembly.

5. The hospital bed of claim 3 in which said safety apparatus includes a pulley-like member mounted to the frame.

6. The hospital bed of claim 3 in which said safety apparatus includes means for taking up slack in the elongate flexible member.

7. The hospital bed of claim 2 in which said interconnecting means includes a pair of left and right blocking members respectively associated with the left and right guard rails, means responsive to the left guard rail being in an inoperative position for moving the right blocking member into a blocking position in which it prevents movement of the right guard rail to the inoperative position, and means responsive to the right guard rail being in an inoperative position for moving the left blocking member into a blocking position in which it prevents movement of the left guard rail to the inoperative position.

8. The hospital bed of claim 7 in which said right guard rail responsive means includes means for mechanically interconnecting the right guard rail with the left blocking member, and said left guard rail responsive means includes means for mechanically interconnecting the left guard rail with the right blocking member.

9. The hospital bed of claim 7 including means for locking said guard rails in their operative position, and in which said blocking member moving means includes means for moving each of the blocking members to a position in which it prevents unlocking of an associated guard rail when an opposite guard rail is in an inoperative position.

10. The hospital bed of claim 1 in which said safety apparatus includes means for disabling both of said guard rail movement preventing means.

11. The hospital bed of claim 10 in which said safety apparatus includes means for providing an alarm indication in response to disablement of either of said guard rail movement preventing means.

12. The hospital bed of claim 1 in which each of the guard rail movement preventing means includes means for generating an electrical detection signal in response to sensing the oppositely associated guard rail in an inoperative position.

13. The hospital bed of claim 12 in which said sensing means includes an electrical switch associated with each guard rail, and means for actuating the switch in response to the movement of its associated guard rail to an inoperative position.

14. The hospital bed of claim 1 in which each of said guard rail movement preventing means includes means for blocking movement of its directly associated guard rail in response to a sensor electrical signal.

15. The hospital bed of claim 14 in which said guard rail movement preventing means includes means for deactuating said blocking means in response to an override electrical signal.

16. The hospital bed of claim 1 in which each of said guard rail movement preventing means includes a sensor for detecting when the opposite guard rail is in an inoperative position, and means responsive to said sensor for blocking movement to an inoperative position of at least the guard rail with which it is directly associated.

17. The hospital bed of claim 16 in which said sensor responsive means is responsive to either of said guard rails being in an inoperative position to block movement of both the guard rails from an operative to an inoperative position.

18. The hospital bed of claim 16 in which the safety apparatus including another sensor, and in which said responsive means includes a binary logic gate with a pair of inputs respectively connected with the one and the other of said sensors.

19. The hospital bed of claim 16 in which said safety apparatus includes means for at least temporarily disabling said movement blocking means.

20. The hospital bed of claim 19 in which the safety apparatus includes an alarm, and means for actuating said alarm in response to disablement of said movement blocking means.

21. The hospital bed of claim 1 in which said safety apparatus includes means for detecting when an attendant is standing at either side of the patient support assembly, means for actuating the movement preventing means directly associated with the guard rail at either side to prevent its movement to an inoperative position even if the other guard rail is in an operative position, and means responsive to the attendant detection means for disabling the actuating means.

22. The hospital bed of claim 21 in which said safety apparatus includes means for automatically raising the guard rails from an inoperative to an operative position, and means for actuating said guard rail raising means in response to said detecting means failing to detect the presence of an attendant at the side of the patient support assembly to raise the guard rail at said side.

23. The hospital bed of claim 1 in which
said patient support assembly has an adjustable frame, and
said safety apparatus includes means responsive to either of said guard rails being in an inoperative position for preventing adjustment of said adjustable frame.

24. The hospital bed of claim 1 in which said safety apparatus includes
means for preventing translational movement of the hospital bed, and
means for actuating said translational movement preventing means in response to either of said guard rails being in an inoperative position.

25. The hospital bed of claim 1 in which
each of said movement preventing means includes a sensor for detecting whether the guard rail is in an inoperative position, and said safety apparatus includes
means for selectively adjusting the sensitivity of said sensing means to detect inoperability at different preselected positions of the guard rail.

26. In a hospital bed having a frame, a patient support assembly mounted to the frame, a pair of left and right guard rails on opposite sides of the patient support assembly and means for mounting the guard rails to the frame for movement between relatively operative and inoperative positions in which they are relatively more and less effective to restrain the patient against lateral movement off the side of the patient support assembly directly associated therewith, the improvement being a guard rail actuated safety apparatus, comprising:
an alarm; means for sensing when both of the pair of said guard rails are in a relatively inoperative position; and
means responsive to said sensing means for actuating the alarm in response to both of said guard rails being sensed in an inoperative position.

27. The hospital bed of claim 26 in which said responsive means includes a binary logic gate for providing an actuation signal only when both of the guard rails are sensed as being in an inoperative position.

28. The hospital bed of claim 26 in which said sensing means includes a pair of sensor switches respectively associated with said pair of rails.

29. The hospital bed of claim 26 in which the safety apparatus includes
means for preventing translational movement of the bed, and
means responsive to said sensing means for actuating said translational movement preventing means to prevent said translational movement when both of said guard rails are in an inoperative position.

30. The hospital bed of claim 26 including means for detecting the presence of an attendant at the side of the patient support assembly, and
means responsive to said detecting means for automatically deactuating said alarm while an attendant is being detected at a side of the patient support assembly despite both of the guard rails being sensed in an inoperative position.

31. The hospital bed of claim 26 in which
said patient support assembly includes an adjustable frame, and
said safety apparatus includes means responsive to said sensing means for preventing adjustment to said adjustable frame when either and when both of said guard rails are in an inoperative position.

32. The hospital bed of claim 26 in which said safety apparatus actuation means for adjusting the position of said sensing means relative to the guard rails to preselected different inoperative positions.

33. In a hospital bed having a frame, a patient support assembly mounted to the frame, a pair of left and right guard rails on opposite sides of the patient support assembly and means for mounting the guard rails to the frame for movement between relative inoperative and operative positions in which they are relatively less and more effective to restrain the patient against lateral movement off the side of the patient support directly associated therewith, the improvement being a guard rail actuated safety apparatus, comprising:
an alarm condition responsive means for initiating patient protection measures;
means for sensing when at least one of the guard rails is in an inoperative position;
a resettable timer for measuring a preselected time period;
means responsive to said sensing means for actuating said timer to initiate measurement of said preselected time period when the at least one guard rail is moved to the inoperative position;
means responsive to said sensing means for resetting said timer when the at least one guard rail is moved to an operative position; and
means for actuating said alarm condition responsive means in response to lapse of said preselected time period before the timer is reset.

34. The hospital bed of claim 33 in which the alarm condition responsive means includes means for automatically raising of the at least one guard rail to an operative position.

35. The hospital bed of claim 34 in which said actuating means includes means for establishing a time delay between lapse of the preselected time period and actuation of said raising means.

36. The hospital bed of claim 33 in which said alarm condition responsive means includes means for providing an audible alarm.

37. The hospital bed of claim 33 in which said alarm condition responsive means includes means, when actuated, for preventing adjustment of the patient support assembly relative to the frame.

38. The hospital bed of claim 33 in which said alarm condition responsive means includes means for preventing translational movement of the frame when actuated.

39. The hospital bed of claim 33 in which
said sensing means includes a pair of sensors for respectively sensing when either of said pair of guard rails is in an operative position, and
said timer actuating means includes means for actuating said timer only when both of said sensors detect both the guard rails in an inoperative position.

40. In a hospital bed having a frame, a patient support assembly mounted to the frame, a pair of left and right guard rails on opposite sides of the patient support assembly and means for mounting the guard rails to the frame for movement between relatively inoperative and operative positions in which they are relatively less and more effective to restrain the patient against lateral movement off the side of the patient support assembly directly associated therewith, the improvement being a guard rail actuated safety apparatus, comprising:
means for initiating at least one patient protection measure in response to an alarm condition;

means for sensing when at least one of the pair of guard rails is in its operative position;

means for detecting the presence of a person standing adjacent the at least one guard rail;

means responsive to both the sensing means and the detecting means for actuating the alarm condition responsive means in response to the at least one guard rail being in an inoperative position except when the presence of a person standing next to the at least one guard rail is being detected.

41. The hospital bed of claim 40 in which said alarm condition responsive means includes an audible alarm.

42. The hospital bed of claim 40 in which said alarm condition responsive means includes means for preventing adjustment of the patient support assembly relative to the frame in response to an alarm condition.

43. The hospital bed of claim 40 in which said alarm condition responsive means includes means for preventing translational movement of the frame.

44. The hospital bed of claim 40 in which said detecting means comprises an electromechanical switch connected to the frame, and an actuator to be engagable by a person's body for actuating the switch when standing alongside the at least one guard rail.

45. The hospital bed of claim 40 in which said detecting means includes a light source, a photosensor, and means for mounting the light source and photosensor to the frame in a location for light to pass therebetween except when blocked by the presence of a person standing alongside the at least one guard rail.

46. The hospital bed of claim 45 in which said mounting means includes means for mounting the source and sensor for movement between at least one operative position in which they extend laterally from the side of the patient support assembly to an inoperative position in which they are located adjacent the side of the patient support assembly.

47. The hospital bed of claim 40 in which said detecting means comprises a foot actuatable switch positionable on the floor adjacent the side of the patient support assembly.

48. The hospital bed of claim 40 in which said detecting means includes a switch, means for actuating the switch through interaction with a person standing adjacent the at least one guard rail, and means for automatically moving the switch to a non-actuated state when a person is not present and no longer interacting with the actuating means.

49. The hospital bed of claim 40 in which said detecting means includes a proximity sensor.

50. In a hospital bed having a frame, a patient support assembly mounted for adjustable movement relative to the frame, a pair of left and right guard rails on opposite left and right sides of the patient support assembly and means for mounting the guard rails to the frame for movement between inoperative and operative positions in which they are relatively less and more effective to restrain the patient against lateral movement off the side of the patient support assembly directly associated therewith, the improvement being a guard rail actuated safety apparatus, comprising:

means for preventing adjustment of the patient support assembly relative to the frame;

means for sensing when at least one of said guard rails is in an inoperative position; and means responsive to said sensing means for actuating the adjustment preventing means.

51. The hospital bed of claim 50 including an electrical motor and in which the patient support assembly is mounted for movement powered by the electrical motor, and said movement preventing means includes means for terminating electrical power to the motor.

52. The hospital bed of claim 50 in which said patient support assembly has an articulated frame mounted for adjustable movement, and said preventing means includes means for preventing said adjustable movement.

53. The hospital bed of claim 50 in which said patient support assembly is mounted for manual adjustment, and said movement preventing means includes means for preventing said manual adjustment.

54. The hospital bed of claim 50 in which said safety apparatus includes means for providing an alarm indication, means for disabling the adjustment preventing means, and means responsive to said disablement of the adjustment preventing means for actuating the alarm.

55. The hospital bed of claim 50 in which said safety apparatus includes means for preventing translational movement of the frame across the floor surface, and means responsive to the sensing means for actuating said translational movement preventing means.

56. The hospital bed of claim 50 in which said adjustment preventing means includes a jam member for blocking movement of an adjustment mechanism, and means for mechanically linking the jam member for movement into a jam position in response to movement of the at least one guard rail into an inoperative condition.

57. In a hospital bed having a frame, a patient support assembly mounted to the frame, a pair of left and right guard rails on opposite left and right sides of the patient support assembly, and means for mounting the guard rails for movement between relatively inoperative and operative positions in which they are relatively less and more effective to restrain the patient against lateral movement off the side of the patient support assembly directly associated therewith, the improvement being a guard rail actuated safety apparatus, comprising:

a remotely engagable braking apparatus mounted to the frame to selectively restrain translational movement of the frame across a floor surface; and means connected with the braking apparatus and responsive to the at least one guard rail being in an inoperative position to automatically engage the braking apparatus.

58. The hospital bed of claim 57 in which said braking apparatus includes a member which moves into a position of interaction with a floor surface to restrain movement.

59. The hospital bed of claim 57 including rolling mounting members attached to the frame to facilitate translational movement thereof across a floor surface, and in which said braking apparatus includes means for interacting with at least one of said rolling members.

60. The hospital bed of claim 57 in which said safety apparatus includes means for providing an alarm, and means for enabling the alarm providing means in response to movement of the at least one guard rail into an inoperative position.

61. The hospital bed of claim 60 in which the alarm providing means includes means powered by the translational movement of the frame only when enabled.

62. The hospital bed of claim 57 in which said brake engaging means includes a mechanical linkage connected between the at least one guard rail and the braking apparatus.

63. The hospital bed of claim 57 in which said braking apparatus includes an electromechanical brake actuator, and said engaging means includes an electrical sensor for detecting when the at least one guard rail is in an inoperative position, and means responsive to the electrical sensor to apply an actuation signal to the electromechanical brake actuator connected thereto.

64. In a bed with a frame, a patient support assembly mounted to the frame and having a pressurizable member of a medical apparatus for interacting with the patient's body resting thereon, a pair of left and right guard rails opposite left and right sides of the patient support assembly and means for mounting the guard rails for movement between relatively inoperative and operative positions in which they are relatively less and more effective to restrain a patient against lateral movement off a side of the patient support assembly directly adjacent thereto, the improvement being a guard rail actuated safety apparatus, comprising:

means for depressurizing said pressurizable member;

means for sensing when at least one of the guard rails is in an inoperative position; and means responsive to said sensing means detecting a guard rail in an inoperative position for actuating said depressurizing means to depressurize said pressurizable member.

65. The hospital bed of claim 64 in which said pressurizable member has holes therein for impingement of pressurized air against the patient's body, said medical apparatus includes means for pressurizing said pressurizable member, and said depressurizing means includes means for deactuating the pressurizing means.

66. The hospital bed of claim 64 in which said depressurizing means includes means for selectively venting said pressurizable member to atmosphere.

67. The hospital bed of claim 64 in which said pressurizable member has a pair of flexible members which are selectively pressurized to turn the patient's body.

68. The hospital bed of claim 64 in which safety apparatus includes means for initially preventing said pressurizable member from being pressurized if the at least one of the guard rails is in an inoperative position.

69. The hospital bed of claim 64 in which said safety apparatus includes an alarm, and means for actuating the alarm in response to the at least one of the guard rails being in an inoperative position.

70. The hospital bed of claim 69 in which said safety apparatus includes means for disabling said alarm when the medical apparatus is not being operated to pressurize the pressurizable member.

71. In a hospital bed having a frame, a patient support assembly mounted to the frame a pair of left and right guard rails on opposite left and right sides of the patient support assembly and means for mounting the guard rails for movement between relatively inoperative and operative positions in which they are relatively less and more effective to restrain the patient against lateral movement off the side of the patient support assembly adjacent thereto, the improvement being a guard rail actuated safety apparatus, comprising:

means for sensing when a guard rail is placed into an inoperative position;

means for raising the guard rail to an operative position; and means responsive to the sensing means for actuating said raising means.

72. The hospital bed of claim 71 in which said responsive means includes a time delay apparatus for delaying a preselected time period after sensing of a guard rail in an inoperative position.

73. The hospital bed of claim 71 including an attendant detector, and in which said actuating means includes means responsive to said attendant detector for disabling actuation of the raising means in response to detection of an attendant at the side of the patient support.

74. The hospital bed of claim 71 in which said safety apparatus comprises only mechanical parts and mounts.

75. The hospital bed of claim 71 in which said raising means includes an electrical motor.

* * * * *

UNITED STATES PATENT AND TRADEMARK OFFICE

CERTIFICATE OF CORRECTION

PATENT NO. : 4,998,939

DATED : March 12, 1991

INVENTOR(S) : Potthast et al.

It is certified that error appears in the above-identified patent and that said Letters Patent is hereby corrected as shown below:

Col. 4, line 55, after "diagram" insert - for-;

col. 4, line 55, after "the" delete the two commas;

Col. 8, line 66, after "has" delete "o"; and

Col. 14, line 42, after "wheel" insert - or alarm providing means -.

Signed and Sealed this

First Day of September, 1992

*Attest:*

DOUGLAS B. COMER

*Attesting Officer*

*Acting Commissioner of Patents and Trademarks*